United States Patent [19]

Zeblisky

[11] 4,187,198

[45] * Feb. 5, 1980

[54] NOVEL PRECIOUS METAL SENSITIZING SOLUTIONS

[75] Inventor: Rudolph J. Zeblisky, Hauppauge, N.Y.

[73] Assignee: Kollmorgen Technologies Corp., Dallas, Tex.

[ * ] Notice: The portion of the term of this patent subsequent to Jun. 27, 1989, has been disclaimed.

[21] Appl. No.: 898,805

[22] Filed: Apr. 24, 1978

Related U.S. Application Data

[63] Continuation of Ser. No. 869,237, Jan. 13, 1978, which is a continuation of Ser. No. 639,440, Dec. 10, 1975, abandoned, which is a continuation of Ser. No. 531,724, Dec. 11, 1974, Pat. No. 3,960,573, which is a continuation of Ser. No. 278,429, Aug. 7, 1972, abandoned, which is a continuation-in-part of Ser. No. 9,060, Feb. 5, 1970, abandoned, which is a continuation-in-part of Ser. No. 801,167, Feb. 20, 1969, Pat. No. 3,672,938, which is a continuation-in-part of Ser. No. 712,575, Mar. 12, 1968, abandoned, which is a continuation of Ser. No. 551,249, May 19, 1966, abandoned, which is a continuation of Ser. No. 285,889, Jun. 6, 1963, abandoned, which is a continuation of Ser. No. 53,352, Sep. 1, 1960, abandoned.

[51] Int. Cl.[2] ..... B01J 27/08; B01J 27/10

[52] U.S. Cl. ..... 252/434; 252/441; 106/1.11; 427/299; 427/304; 427/305; 427/306

[58] Field of Search ..... 106/1; 427/299, 304, 427/305, 306; 252/441, 429 R, 438, 472, 473, 474, 475, 476

[56] References Cited

U.S. PATENT DOCUMENTS

| | | | |
|---|---|---|---|
| 3,672,923 | 6/1972 | Zeblisky | 106/1 X |
| 4,020,009 | 4/1977 | Gulla | 252/429 R |

*Primary Examiner*—Patrick Garvin

*Attorney, Agent, or Firm*—Morgan, Finnegan, Pine, Foley & Lee

[57] ABSTRACT

Sensitizing solutions for rendering surfaces receptive to the deposition of adherent electroless metal comprising a precious metal and a stoichiometric excess of a Group IV metal which is capable of two valence states are stabilized against precious metal separation by adding a Lewis Base, e.g., hydroquinone or hydroxylamine. Processes for rendering surfaces receptive to the deposition of an electroless metal are also provided in which there are employed the stabilized sensitizing solutions.

10 Claims, No Drawings

NOVEL PRECIOUS METAL SENSITIZING SOLUTIONS

CROSS-REFERENCES TO RELATED APPLICATIONS

This application is a continuation of U.S. application Ser. No. 869,237, filed Jan. 13, 1978, which in turn is a continuation of U.S. application Ser. No. 639,440, filed Dec. 10, 1975, now abandoned, which in turn is a continuation of U.S. application Ser. No. 531,724, filed Dec. 11, 1974, now U.S. Pat. No. 3,960,573, which in turn is a continuation of U.S. application Ser. No. 278,429, filed Aug. 7, 1972, now abandoned, which in turn is a continuation-in-part of U.S. application Ser. No. 9,060, filed Feb. 5, 1970, now abandoned which in turn is a continuation-in-part of U.S. application Ser. No. 801,167 filed Feb. 20, 1969, now U.S. Pat. No. 3,672,938, which in turn is a continuation-in-part of U.S. application Ser. No. 712,575, filed Mar. 12, 1968, now abandoned, which in turn is a continuation of U.S. application Ser. No. 551,249, filed May 19, 1966, now abandoned, which in turn is a continuation of U.S. application Ser. No. 285,889, filed June 6, 1963, now abandoned, which in turn is a continuation of U.S. application Ser. No. 53,352, filed Sept. 1, 1960, now abandoned.

Generally stated, the subject matter of the present invention relates to stabilized precious metal sensitizing solutions. More particularly, the invention relates to such solutions stabilized against precious metal deposition by incorporation of a Lewis Base. The stabilized solutions are used to render surfaces of a substrate catalytic to the reception of an electroless metal.

BACKGROUND OF THE INVENTION

The electroless deposition of a metal, e.g., a Group IB metal, i.e., copper, silver or gold, on either a metallic or non-metallic substrate usually requires pretreatment or sensitization of the substrate to render it catalytic to the reception of such deposit. Various methods have evolved over the years employing particular sensitizing compositions.

One of the most useful methods employs an aqueous solution consisting of two essential ingredients, a precious metal, e.g., palladium, gold, platinum, and the like, and a stoichiometric excess of a divalent Group IV metal, e.g., stannous tin. Such solutions are referred to as sensitizing solutions and often simply as seeders. Preferred sensitizing solutions are described in the said copending applications Ser. No. 53,352 (see also Canadian Patent No. 731,042); Ser. No. 285,889; Ser. No. 551,249; Ser. No. 712,575; U.S. Pat. No. 3,672,938, and Ser. No. 9,060, the disclosures of which are incorporated herein by reference. Especially useful forms of the sensitizing compositions, e.g., concentrates and dilutable solids, are disclosed in copending applications Ser. Nos. 9,060, and 50,918, now U.S. Pat. No. 3,672,923, the disclosures of which are also incorporated herein by reference.

A common problem with such sensitizing solutions, e.g., those of the palladium-stannous chloride type, has been instability. It appears that under the influence of air, oxidation of stannous tin to unusable stannic compounds or even insoluble stannic compounds tends to occur. Not only does this reduce the efficiency and effectiveness of the sensitizing solution, but it also seems to permit the precious metal to precipitate from solution, whereupon it forms a residue on any surface exposed to it. If the surface is a work-piece later to be electrolessly plated, such a flash coating reduces adhesion of the electroless metal. On the other hand, if the surface is part of the container holding the sensitizing solution, the precious metal will be lost from the bath and the process control is upset.

It has now been discovered that the addition of certain Lewis Bases, which are soluble in the sensitizer solution, will protect the sensitizer from decomposition.

While the reason for this useful effect is not clearly understood, it appears that the Lewis Base will react with and protect the reaction product of precious metal ion and Group IV metal ion to prevent reduction of the precious metal ion to free metal, e.g., precious in the colloidal state.

Merely by way of illustration, if hydroquinone, hydroxylamine, ethylene glycol, methanol and the like, are added to such sensitizing solutions, they dissolve and remain in solution, and any oxygen subsequently introduced into the solution from the air appears to be much less effective in causing the reaction product to be upset and decompose and, ultimately, precipitation of the precious metal is postponed or precluded.

It is unexpected to find that such Lewis Bases can be used as stabilizers without causing the sensitizing solution to become less useful for the desired purpose. It has been known, e.g., from Canadian Patent No. 731,042, that many precious metals are bound into a reaction product with the Group IV divalent metal, and it would be expected that extraneous compounds having an unshared electron pair (Lewis Bases) would tend to split or otherwise disrupt any such product. Lewis Bases as defined herein are compounds which provide a pair of electrons to form a new covalent bond by sharing them with an atom having an "open sextet" of electrons. Among the most common Lewis Bases are organic compounds containing oxygen, e.g., alcohols, ethers, phenols, hydroquinones, etc., nitrogen, e.g., ammonia, amines such as aniline, hydroxylamine, and the like, and many others.

Lewis Bases are defined herein in the same sense employed by standard works well known to those skilled in the art, e.g., G. W. Wheland, "Advanced Organic Chemistry," 2nd Edition, John Wiley & Sons, New York 1949, pp. 80–84, the disclosure of which is incorporated herein by reference.

Accordingly, it is a primary object of the present invention to provide stabilized sensitizer solutions that are highly active, as well as a process using such solutions to effect the sensitization of a substrate to render it catalytic to the reception of an electroless metal deposit.

Another object of the present invention is to provide new and useful stabilized compositions which are true solutions and methods for sensitizing substrates using them which substantially obviate the problem of non-adherent precious metal flash coatings.

It is an additional object of the invention to provide clear, stable sensitizing compositions and processes for the use thereof which materially reduce the time necessary to effect sensitization.

Additional objects and advantages will be set forth in part in the description which follows, and in part will be obvious from the description, or may be realized by practice of the invention, the objects and advantages being realized and attained by means of the methods, processes, instrumentalities and combinations particularly pointed out in the appended claims.

DESCRIPTION OF THE INVENTION

To achieve the foregoing objects, and in accordance with its purposes as embodied and broadly described, the present invention provides acidic aqueous solutions for the sensitization of conductive and nonconductive surfaces to the reception of adherent electroless metal which comprise an effective amount, e.g., from about 0.01 to about 5.0 grams per liter, of precious metal ions; an excess of a stoichiometric amount of a Group IV metal of the Periodic Table of Elements which is capable of two valence states; and a stabilizing amount, at least sufficient to prevent separation from the solution of the precious metal as a metallic film or precipitate, of a Lewis Base, i.e., a compound capable of detonating a pair of electrons to form a coordinate covalent bond with a compound containing an atom having an "open sextet," i.e., a Lewis Acid.

Also contemplated are stable, compositions which include an anion capable of forming a stable moiety with both valence states of the Group IV metal. Special mention is made of such sensitizing solutions in which the molar ratio of precious metal ion to Group IV metal ion to anion is at least about 1:6:42, and wherein the ions are in the form of a completely soluble, stable, precious metal-containing reaction product (as described in U.S. Ser. No. 53,352 and Canadian Patent No. 731,042).

A preferred feature of the invention is a stabilized solution as above defined wherein the Lewis Base is selected from hydroquinone or hydroxylamine. An illustrative range of concentration for the Lewis Base is from about 1.0 to 100 grams per liter, preferably 5 to 50 grams per liter although more and less can be used.

Among the precious metals which can be used are those of Periods 5 and 6 of Groups IB and VII of the Periodic Table of Elements. Special mention is made of palladium, platinum, gold, rhodium, osmium and iridium. The preferred precious metal is palladium. The preferred Group IV metal is tin, especially stannous tin.

It is preferred that the pH of the solution be maintained below about 1.0.

Another preferred feature of the invention is to provide the palladium ions, the stannous ions and chloride ions in the form of a $Pd\ Cl_2.SnCl_2$ reaction product, and to insure that there is a stoichiometric excess, i.e., stannous tin ions and chloride anions unreacted with the reaction product. In its broadest aspects, the preferred compositions of this invention contain a soluble reaction product of precious metal ion, an excess of a stoichiometric amount of stannous tin ion, a hydrohalic acid, e.g., HCl or HBr, and the Lewis Base.

It is a further feature of the present invention to provide an improved process for rendering surfaces receptive to the deposition of an adherent electroless metal, as well as a process for electrolessly depositing a metal on a substrate which has been sensitized with the stabilized sensitizing solutions of the present invention.

The invention consists of the novel methods, processes, steps and improvements described herein.

It is to be understood that both the foregoing general description and the following detailed description are exemplary and explanatory and are not restrictive of the invention. For example, while copper deposition is more fully described, the teachings are applicable to nickel, palladium, cobalt, silver and gold deposition as well.

The stabilized compositions of this invention will cause conductive and non-conductive materials to be so sensitized simultaneously that efficient and uniform deposition of an adhering electroless metal thereon may be readily effected. This permits, by way of illustration, copper plating of non-metallic surfaces of side walls in apertures in a plastic base material, as well as the concomitant adherent electroless deposition of copper on preformed copper surfaces on the base. Illustrative of the conductive and non-conductive, metallic and non-metallic surfaces which can be plated uniformly with adherent electroless metal by use of the sensitizing solutions and techniques of the present invention are plastic surfaces and surfaces of metallic copper, iron-nickel, cobalt, silver, gold and alloys thereof, such as stainless steel, brass, sterling silver and the like.

The preferred sensitizing solution will comprise an aqueous solution of a metal complex consisting of a precious metal, a Group IV metal and stabilized with the miltivalent cation. They will be optically-clear, i.e., non-colloidal. The precious metals will include palladium, platinum, gold, rhodium, osmium, iridium and mixtures of these metals. The inorganic and organic acid salts of these metals and of the Group IV metals, such as the chlorides, bromides, fluorides, fluoborates, iodides, nitrates, sulfates and acetates of stannous tin, titanium and germanium among others may be used. Other salts and compounds of the precious metals and Group IV metals will readily suggest themselves to those skilled in the art. The salts and compounds are preferably soluble in water, or in organic or inorganic acid aqueous solutions. Among the salts, the chloride is preferred, both for the precious metal and the Group IV metal compound. The preferred precious metals are palladium or platinum, particularly palladium and preferred Group IV metal is stannous tin.

In the sensitizing solution bath the precious metal concentration should be from at least about 0.0003 to about 10 grams per liter, preferably from 0.01 to 5.0 grams per liter of solution. While the higher end of this range causes sensitization to be completed in very abbreviated periods of time, e.g., ten seconds, the lower end of this range is normally more economic. The bath can be prepared directly or by diluting a concentrate.

In one manner of proceeding, the concentrates of ions are diluted with water or an aqueous solution of suitable acid. The concentrates are prepared by heating the salts of the precious metals and a Group IV metal salt in an aqueous solution of suitable acid as will be described hereinafter. Among the acids that may be mentioned are hydrochloric acid, hydrofluoric acid, fluoboric acid, hydroiodic acid, sulfuric acid and acetic acid. Preferably, the anion of the inorganic acid corresponds to the anion of the salt of the precious metals, or to the anion of the Group IV metal salt. Where the anions of the precious metal salt, the Group IV metal salt and the oxidizable multivalent metal are the same, the anion of the acid should preferably correspond to the common anion of the salts. Where the anion of the precious metal differs from that of the Group IV metal salt, the anion of the acid preferably corresponds to the anion of the precious metal salt. However, acids having anions which differ from the anions of the precious metal salts or of the Group IV metal salts may also be used. Preferred anions are $Cl^-$ and $SnCl_3^-$ While it should not be construed as limiting the invention, it is believed that the complexing reaction which occurs between the metals and the anion results in the formation of more than one and possibly several complexes. Empirically, these can be depicted as including complex anions of the formula $[Cl_2Me(SnCl_3)_2]^{-2}$;
$[Me(SnCl_3)_5]^{-3}$;
$[Cl_2Me_2(SnCl_3)_4]^{-4}$; or
$[Me_3(Sn_8Cl_{20})]^{-4}$; or mixtures thereof, wherein Me is Ru, Rh, Pd, Os, Ir, Pt, Au or a mixture thereof. Preferred complexes are those wherein Me is Pd or Pt.

The concentration of the acid in the sensitizing solutions and in the concentrates depends upon the strength of the acid employed. The concentration of the acid in the final solution should be at least 0.001 Normal. At the upper end, and especially in a concentrate, the concentration of acid may be as high as 15 Normal, or even higher. When strong acids are used, the concentration of the acid in the sensitizing solution generally varies between about 0.02 and 7.5 Normal. When weak acids are used, the concentration of the acid in the sensitizing solution approaches the upper limit given hereinabove. The concentration of acid in the sensitizing solution should, of course, be high enough to solubilize the salts of the precious metals and the Group IV metal and also high enough to render the solution suitable for use as a sensitizer for the material being treated. Care should be used in selecting the acid concentration to insure that the specimen being treated is not adversely attacked or corroded by the treating solution.

The Group IV metal ion concentration may vary widely but must be maintained in excess of a stoichiometric amount based on the amount of precious metal ions present in the sensitizing solution. Although, normally a large excess of, for example, stannous chloride, is maintained to allow for air oxidation of the stannous ion, with a Lewis Base present, such large excesses are not needed. Illustratively, concentrations of as high as 50 grams per liter, or more, of stannous chloride are not detrimental to the effectiveness of the sensitizing activity of the diluted solutions.

As has been mentioned above, addition of the Lewis Bases to the sensitizing solutions of this invention improves the stability of the solutions and avoids formation of precious metal residues on surfaces, e.g., metal surfaces, exposed to such solutions. The chemical nature of the Lewis Base is not particularly critical. It can be simple or complex, but should be soluble at least in an amount great enough to provide the desired stabilization effect. Evidence of effective stabilization is easily observed in comparison with control baths, i.e., those without the Lewis Base present. These latter baths over a period of one week or so will be seen to deposit a metallic film of precious metal or to deposit a precipitate of precious metal. On the other hand, baths to which an effective amount of the stabilizing Lewis Base has been added will remain clear and be stable and storable for periods of at least two weeks and even longer. In any event, the minimum amount will vary somewhat from compound to compound but is easy to determine routinely. There is no apparent reason to limit the quantity of the stabilizing Lewis Base to the minimum effective amount and often substantially more will be used, the choice being primarily dictated by economic considerations.

The stabilizing Lewis Base need not be completely water soluble, although for ease of formulation a high degree of water solubility is desirable. As will be obvious to those skilled in the art, depending on the pH, many normally "insoluble" compounds, e.g., phenols, aniline, and the like, are quite easily soluble. Most compounds of the types specified, if not soluble at neutrality, are easily soluble in acidic media, which are preferred in any event.

It is important, when preparing the sensitizing solutions to be stabilized according to the instant invention, that the aqueous solutions of components be added to each other and mixed so that the components of the aqueous solutions do not react to form a colloidal dispersion or solloidal agglomerates. For example, if one of the aqueous solutions is added, slowly, to the other solution with vigorous agitation, which is standard procedure for preparing a colloidal dispersion, the components of the solutions will react and the mixed, reacted solutions, will form a colloidal dispersion of palladium with a portion of the colloidal palladium precipitated and agglomerated. Such colloidal dispersion is not the clear sensitizing solution which is stabilized according to the present invention nor does such colloidal dispersion result in the improved sensitizing solution of the present invention nor the improved electroless plating resulting from such clear sensitizing solution.

One method found acceptable for producing a clear solution, when the aqueous solutions of components are mixed, is to dissolve the palladium chloride in a solution of hydrochloric acid and water and to quickly dissolve the stannous chloride in the palladium chloride. When so mixed, the stannous chloride acts as a reducing agent and the high concentration of stannous tin forms a complex with the palladium chloride and prevents the reduction of palladium chloride to metallic palladium. The palladium chloride and stannous chloride may be separately dissolved in equal portions of water, hydrochloric acid solution and then mixed together. Such solution must be aged for at least one hour at 25° C. before use. While aging, the color of the solution mixture will change from green to dark brown, indicating that the proper stannous chloride, palladium chloride acid salts have formed and that the solution is ready for addition of stabilizer and, if desired, wetting agent, and use.

Sensitizing solutions of the instant invention can be prepared as stabilized concentrates which may be stored, and shipped and diluted when the sensitizing solution is to be used for electroless plating. When properly prepared, in accordance with the teachings hereof, such diluted concentrates form true, clear solutions.

In practicing this invention with concentrates, they can be prepared in one- or two-steps:

In the one-step preparation, an aqueous mixture, which contains precious metal ion, Group IV ion and an anion as defined above, in which mixture the precious metal ion is present in a concentration of at least about 2.5 grams/liter, the molar ratios of precious metals to Group IV metal to anion each being, respectively, 1: at least 1: at least 3; is heated at a temperature of from about 80° C. to about the boiling point of the mixture until formation of the metal complex is substantially complete, then the solution is cooled and the Lewis Base is added.

In the two-step preparration, an aqueous solution containing a salt of the precious metal at a concentration of from about 2.5 grams/liter up to about the limit of solubility of the salt in water at the boiling point and the anion; and an aqueous solution of Group IV metal and anion, the ratios of precious metal to Group IV metal to anion each being respectively, 1: at least about 1: at least about 3, are first prepared. The two solutions are mixed together and heated at a temperature of from about 80° C. to about the boiling point of the mixture until formation of the complex is substantially complete. With palladium, 4.8 to 100 grams per liter (calculated as metal) can be conveniently used. Depending on the temperature, it is preferred to heat the mixture for from about 20 to 90 minutes, although this is not critical. The solution is cooled and either before or after dilution to the desired concentration of precious metal, the Lewis Base is added.

The treating or sensitization procedure which is one feature of this invention is an intermediate step between pretreatment or cleaning of the surfaces upon which the metal is to be electrolessly deposited and the actual deposition of the metal. The treatment to be afforded the surface to be plated depends upon the cleanliness of the material to be treated and associated factors. Thus, where the surface to be plated is either unclean or its cleanliness uncertain, the first step in the procedure for effecting deposition of adherent electroless metal is to clean thoroughly the article or panel upon which plating is to occur. This is desirably accomplished by scrubbing the panel with pumice or the like to remove heavy soils; rinsing with water; and subsequent removal of soiling due to organic substances from the panel and apertures defined therein with a suitable alkali cleaning composition. A typical alkaline cleaner composition is as follows:

Soldium isopropyl naphthalene sulfonate:—3 grams/-liter
Sodium sulfate:—1 gram/liter
Sodium tripolyphosphate:—14 grams/liter
Sodium metasilicate:—5 grams/liter
Tetrasodium pyrophosphate:—27 grams/liter This operation is desirably performed at a temperature of 160° to 180° F. The surfaces to be plated are permitted to remain in the bath for a period of 5 to 30 minutes. Other suitable alkali cleaning compositions, such as conventional soaps and detergents, may also be used. Care should be used in selecting the detergent to insure that the specimen to be treated is not attacked by the cleaner.

Oxides are removed from copper panel surfaces and apertures by application of a light etching solution such as a 25 percent solution of ammonium persulfate in water as is described in Bulletin No. 86 of the Becco Chemical Division of the Food Machinery and Chemical Corporation, Buffalo 7, N.Y. The surface oxides also may be removed by application of the cupric chloride etchant solution described by Black in U.S. Pat. No. 2,908,557. This treatment should not exceed 2 to 3 minutes.

The treatment period and temperature are significant, particularly where the panel surfaces are formed of a conductive metal, in that elevated temperatures and extended periods of time beyond those described may result in removal not only of the oxide materials but of the conductive metal, such as copper foil, forming the surfaces of the panel. The panel is rinsed thoroughly after this step with water to remove all semblance of etching compounds. Care should be taken to avoid the formation of further oxide film during rinsing or as a result of air oxidation. Subsequent to rinsing, the panel may be inserted in a hydrochloric acid solution comprising 42 fluid ounces of hydrochloric acid per gallon of water for a period of from 2 to 5 minutes, and from this bath the panel is placed in the sensitization or treating solution of the present invention.

If the shape of the material permits, a sanding operation with a fine abrasive can also be used to remove oxides.

DESCRIPTION OF THE PREFERRED EMBODIMENTS

The following examples are provided for illustrative purposes and may include particular features of the invention. However, the examples should not be construed as limiting the invention, many variations of which are possible without departing from the spirit or scope thereof.

EXAMPLE 1

A solution comprising the following ingredients is made:

palladium chloride: 0.5 g./l.
hydrochloric acid (37%): 50 ml./l.
stannous chloride dihydrate: 2.5 g./l.
water (to make): 1000 ml.

The palladium chloride is an aliquot of a solution containing $PdCl_2$ and 37% hydrochloric acid, 50 grams and 50 ml./liter, respectively.

The solution is allowed to stand for approximately one hour at room temperature, during which time the color changes, starting with blue-black, then dark green and deep brown and finally a dark brown. At this stage the solution contains considerable quantities of a catalytically active palladium, stannous chloride complex ($PdCl_2.SnCl_2$ reaction product). The palladium ion in the $PdCl_2.SnCl_2$ reaction product will be reduced and palladium metal will separate from this solution after standing for several days.

To a solution of the palladium chloride-stannous chloride reaction product prepared as described above is added hydroquinone, a Lewis Base, 20 g./l., and a stabilized catalytically-active composition according to this invention is obtained.

EXAMPLE 2

A solution comprising the following ingredients is made:

palladium chloride: 1 g./l.
hydrochloric acid (37%): 280 ml./l.
stannous chloride dihydrate: 40 g./l.
water (to make): 1000 ml.

The palladium chloride is added as an aliquot of a solution in hydrochloric acid.

Boil for 2 minutes and let cool. The color changes to brown.

To this solution of a catalytically active palladium chloride-stannous chloride reaction product is added hydroxylamine, a Lewis Base, as the sulfate, 10 g./l., and boil for 5 minutes, to obtain a stabilized, active composition according to this invention, very resistant to decomposition and the separation of palladium metal.

EXAMPLES 3 and 4

A first solution is prepared comprising the following ingredients:

palladium chloride (g.): 10
hydrochloric acid (37%, ml.): 200
water to make total (ml.): 500

The palladium salt dissolves slowly in the acid-water mixture.

A second solution is prepared comprising the following ingredients:

stannous chloride dihydrate (g.): 710
hydrochloric acid (37%, ml.): 500

The first solution is added to the second with agitation, then the mixture is boiled for 1.5 hours, during which time it changes color from blue or purple, through green, then straw-yellow and, finally, brown.

The mixture is allowed to cool and is diluted with water and acid to produce a catalytically active solution comprising palladium chloride: 1 g./l.
hydrochloric acid (37%): 200 ml./l.
stannous chloride: 60 g./l.
water (balance)

in the form of a palladium, stannous chloride complex.

The stability of the above solution is enhanced according to this invention by adding, respectively, the following Lewis Bases, ethylene glycol, 100 ml./l., and methanol, 200 ml./l.

EXAMPLE 5

The procedure of Example 4 is repeated except that after dilution, the solution containing the palladium chloride-stannous chloride reaction complex comprises:

palladium chloride: 1 g./l.
hydrochloric acid (37%): 330 ml./l.
stannous chloride: 60 g./l.
water (balance).

The stability of the above solution is enhanced according to this invention by adding the Lewis Base, hydroquinone, 45 g./l.

EXAMPLE 6

To an aqueous solution of 60 g./l. of stannous chloride is added enough 10% sodium hydroxide solution to dissolve the tin precipitate, keeping the mixture at about 20°-25° C. An aliquot of a concentrated solution is added to provide $PdCl_2$, 2 g./l. and 2 ml./l. of hydrochloric acid. A black precipitate forms and is removed by decantation. The precipitate is redissolved in a solution of 60 g./l. of stannous chloride and 330 ml./l. of concentrated hydrochloric acid (balance water). This is further diluted with hydrochloric acid and water to give a final solution containing palladium chloride: 1 g./l.
hydrochloric acid (37%): 330 ml./l.
stannous chloride: 60 g./l.
water (balance)

in the form of a catalytically active palladium chloride-stannous chloride reaction product.

The stability of the above solution is enhanced according to this invention by adding the Lewis Base, hydroquinone, 45 g./l.

EXAMPLE 7

The procedure of Example 4 is repeated except that after dilution, the solution containing palladium chloride-stannous chloride reaction complex comprises:

palladium chloride: 0.4 g./l.
hydrochloric acid (37%): 330 ml./l.
stannous chloride: 30 g./l.
water (balance)

The stability of the above solution is enhanced according to this invention by adding the Lewis Base, hydroquinone, 45 g./l.

EXAMPLE 8

The following is an example of a stabilized composition according to this invention, having a molar ratio of palladium ion, stannous ion and chloride ion of about 1:19:42 palladium chloride: 1 g./l.
stannous chloride: 20 g./l.
hydrochloric acid (37%): 1 ml.
hydroquinone: 45 g./l.
water (balance).

EXAMPLE 9

The following is an example of a stabilized composition according to this invention, having a molar ratio of palladium ion, stannous ion and chloride ion of about 1:6:540 palladium chloride: 4 g./l.
stannous chloride: 25 g./l.
hydrochloric acid (37%) (to make): 1000 ml.
hydroquinone: 45 g./l.

As will be noted from Examples 8 and 9, the minimum molar ratio of palladium ion to stannous ion to anion in the solutions of these preferred embodiments will be approximately 1:6:42.

EXAMPLE 10

In a typical manufacturing procedure, a sensitizing solution comprising the following ingredients is prepared:

palladium chloride ($PdCl_2$): 0.25-1 gram
hydrochloric acid (37%) 40-330 ml.
stannous chloride ($SnCl_2.2H_2O$): 12-60 grams
hydroquinone: 5-50 grams
water: to 1000 ml.

This composition is formulated by dissolving palladium chloride in water containing 40 to 60 ml. of 37% hydrochloric acid. Dissolution is slow and continues normally for several hours at room temperature. When the palladium is completely dissolved the stannous chloride is dissolved in the resulting solution. It is noted in this regard that when the stannous chloride is first dissolved in the aforesaid solution a green color may be noticed initially. After about one hour, however, the solution will change to a dark brown color, which coloration indicates that the solution is catalytically active. There is then added hydroquinone (Lewis Base). The panel being prepared for electroless metal, e.g., copper, plating is then immersed in the sensitizing solution for a period of from 5 to 20 minutes at room temperature.

Instead of hydroquinone, hydroxylamine, 50 g./l. (as the sulfate) can be added. In all cases, the stability of the sensitizing solution is markedly enhanced.

With respect to the sensitizing process aspect of this invention, after being immersed in the stabilized solution containing from 0.01 to 5.0 grams/liter of precious metal ion for the suitable period of time, the panel surfaces including any side walls of the apertures defined therein are thereafter thoroughly rinsed with water to entirely remove the sensitizing solution therefrom. The panel may then, if desired, be passed through a further bath of lactic acid, suitably diluted, e.g., about 10-20 percent, the passage employing a period of from 10 to 20 seconds, and the panel is again rinsed with water prior to immersion in a suitable electroless plating bath.

Conventional electroless metal, e.g., copper, silver, gold, nickel, cobalt, etc., plating baths may be used for the deposition of the adherent metal after sensitizing of the plating surface with the compositions of the present invention. The electroless copper deposition may be followed by electroplating with copper or other metals to build up copper thicknesses of 0.001 to 0.002 inch or greater.

As an example, in the printed circuit industry, electroless copper is ordinarily deposited on apertures formed in plastic insulation sheets which have conductive copper foil laminated on both top and bottom surfaces. Following deposition of electroless copper, the circuits are conventionally electroplated with copper or other metals to build up copper thicknesses of 0.001 to 0.002 inch or greater.

Electroplated copper is required over the electroless copper to form rugged conductive copper on the walls of the aperture approximately 0.001 inch thick or greater. However, in the prior art the adhesion between the electroless copper and the foil originally laminated to the plastic sheet has been very poor due to a poorly adherent flash coating of precious metal from the catalyzing step. The subsequent electrodeposits fail because of the flash coating and can easily be stripped off merely by the application of pressure sensitive adhesive coated cellophane tape such as "Scotch" cellophane tape manufactured by the 3M Company. Therefore, prior to the advent of the present invention, in order to achieve adherent coating, the surface of the copper foil had to be mechanically abraded before electroplating to remove all trace of the electroless copper deposits. This was a costly and time-consuming operation. By using the sensitizing solutions of the present invention, however, it is not necessary to abrade the surface to remove the electroless copper. The electroplated copper may be deposited directly and will adhere so strongly that if the plastic base sheet is broken, the copper foil may be bent back and forth on itself until it breaks but no separation is evident between the original laminated foil and the electroplated copper film.

Although the invention has been described and illustrated by reference to particular embodiments thereof, it will be understood that in its broadest aspects the invention is not limited to such embodiments, and that variations and substitution of such equivalents may be resorted to within the scope of the appended claims.

I claim:

1. A process for the formation of an essentially dry composition which, upon admixture with an aqueous solution containing about 12 to 18.5% hydrochloric acid, forms a stable catalyst solution for catalyzing a substrate prior to deposition of an electroless metal, said process comprising the steps of providing a liquid catalyst solution that is the product of admixture in hydrochloric acid of a catalytic metal halide with a stannous halide in molar excess of the catalytic metal halide, said liquid catalyst composition comprising acid in an amount sufficient to prevent hydrolysis; drying said liquid catalyst composition; and mixing stannous halide with the product obtained by drying said liquid catalyst composition to protect against the effects of atmospheric oxidation, said stannous halide being added in excess.

2. The process of claim 1 where the catalytic metal halide is a halide of a member selected from the group of halides of gold, platinum, palladium, rhodium, osmium, iridium, and mixtures thereof.

3. The process of claim 2 where all of said halides are chlorides.

4. The process of claim 3 where said catalytic metal is palladium.

5. The product formed by the process of claim 1.

6. The product formed by the process of claim 4.

7. A process for making a catalyst composition for catalyzing a substrate prior to electroless metal deposition, said process comprising dispersing the product of claim 6 in an aqueous solution containing about 12 to 18.5% hydrochloric acid.

8. A process for making a catalyst composition for catalyzing a substrate prior to electroless metal deposition, said process comprising dispersing the product of claim 6 in an aqueous solution of an acid having a concentration sufficient to prevent hydrolysis of the tin component at the final concentration of the mixture.

9. A process for making a catalyst composition for catalyzing a substrate prior to electroless metal deposition, said process comprising dispersing the product of claim 5 in an aqueous solution containing about 12 to 18.5% hydrochloric acid.

10. A process for making a catalyst composition for catalyzing a substrate prior to electroless metal deposition, said process comprising dispersing the product of claim 5 in an aqueous solution of an acid having a concentration sufficient to prevent hydrolysis of the tin component at the final concentration of the mixture.

* * * * *